United States Patent [19]

Agladze et al.

[11] 4,269,689

[45] May 26, 1981

[54] ELECTROLYZER FOR CONDUCTING ELECTROLYSIS THEREIN

[76] Inventors: Rafael I. Agladze, prospekt Plekhanova, 86/90, kv. 1; Erik A. Manukov, Digomsky massiv, 4 kvartal, 22 korpus, kv. 39; Georgy R. Agladze, prospekt Plekhanova, 86/90, kv. 1, all of Tbilisi, U.S.S.R.

[21] Appl. No.: 74,302

[22] Filed: Sep. 11, 1979

Related U.S. Application Data

[63] Continuation of Ser. No. 748,388, Dec. 7, 1976, abandoned.

[51] Int. Cl.[3] ..... C25B 1/28

[52] U.S. Cl. ..... 204/268; 204/1 R; 204/82; 204/222; 204/277

[58] Field of Search ..... 204/1 R, 82, 268, 277, 204/222

[56] References Cited

U.S. PATENT DOCUMENTS

| | | | |
|---|---|---|---|
| 3,716,459 | 2/1973 | Salter et al. | 204/1 R |
| 3,761,383 | 9/1973 | Backhurst et al. | 204/268 |
| 3,945,892 | 3/1976 | James et al. | 204/1 R |
| 3,969,201 | 7/1976 | Oloman et al. | 204/1 R |
| 4,019,968 | 4/1977 | Spaziantz et al. | 204/268 |
| 4,053,378 | 10/1977 | Moeglich et al. | 204/1 R |
| 4,124,453 | 11/1978 | Fleischmann et al. | 204/1 R |
| 4,131,526 | 12/1978 | Moeglich | 204/1 R |

OTHER PUBLICATIONS

Le Goff et al., "Applications of Fluidized Beds in Electrochemistry", Industrial & Engineering Chemistry, vol. 61, No. 10, Oct. 1969, pp. 8–17.

"Nature", vol. 223, Sep. 6, 1969, pp. 1034 & 1035.

*Primary Examiner*—T. Tung

*Attorney, Agent, or Firm*—Haseltine and Lake

[57] ABSTRACT

An electrolyzer for obtaining chemical products, comprising a cell having its inner surface made from a dielectric material, and filled with a circulating electrolyte; the cell accommodates current leads which are nonsoluble, the space between the current leads and the walls of the cell being filled with pieces of a conducting material, said pieces serving as a bulk electrode, and as these pieces react with the electrolyte, a coat of film is formed thereon, which promotes the bipolar action of said pieces when the current leads are energized; in addition, the cell is provided with a means for discharging slime and the products of electrolysis.

A method of conducting electrolysis in the electrolyzer, which consists in charging the space between the current leads in layers with pieces of a conducting material, which pieces, when reacting with the circulating electrolyte, receive a coat of film of high resistance, said film promoting the bipolar action of the pieces and preventing current leakage through the metallic contact between said pieces; the current leads in the electrolyzer are then energized, creating an electric field providing for a potential difference across the oppositely charged portions of adjacent pieces, said potential difference being sufficient for obtaining the desired product; the electrolyte is made to circulate through the use of the lifting force of the gases evolving during the electrolysis, said gases saturating the electrolyte impairing its conductivity and impeding thereby current leakage through the electrolyte.

7 Claims, 3 Drawing Figures

ELECTROLYZER FOR CONDUCTING ELECTROLYSIS THEREIN

This is a continuation of application Ser. No. 748,388 filed Dec. 7, 1976, now abandoned.

The present invention relates to the chemical industry, and more specifically, to electrolyzers and methods of conducting electrolysis therein for obtaining chemical products.

The present invention is of particular advantage in non-diaphragm chemical processes, for instance, for producing oxidizers, namely permanganates, chromates, bichromates through anodic dissolution of alloys or metals as well as oxychloric compounds, such as chlorates and hypochlorites, at non-soluble electrodes.

The prior art commercial electrochemical processes are conducted in diaphragmless electrolyzers having electrodes made in the form of solid plates or rods. The soluble electrodes are made by remelting raw material and casting in special molds, after which said anodes are scaled and secured on rods. All these procedures require manual labor. The anodes and cathodes are connected in parallel within the electrolyzers, the latter being connected in series. The use of such methods normally involves power losses across the contacts of the electrodes and connecting bars. The processes carried out on the surfaces of flat electrodes necessitate large floor areas, hence, these methods are less compatible with metallurgical or catalytic methods of raw material processing, whereby the process is carried out throughout the entire volume of the reactor.

Known in the art are various methods of increasing the capacity of electrolyzers, which have been proposed with the object of intensifying electrochemical processes. Most of these methods are aimed to increase the electrolyzer efficiency by feeding current of higher intensity to the developed surface of the electrodes. With this object in view, there have been proposed various porous electrodes and different types of bulk electrodes. With the same aim in view, there have been proposed electrodes provided with a fluidized layer composed of fine particles maintained in a suspended state by a flowing electrolyte.

All the above embodiments have common disadvantages, residing, particularly, in that the processes are carried out not throughout the entire volume of an electrolyzer but only at a small depth of the electrode's boundary layer facing the electrode of the opposite sign. The rest of the electrode serves as a current lead wherein electric power is lost because of the high resistance. The above embodiments require low voltage along with high current intensity, which is not economical.

To make use of high voltage, there has been proposed electrolyzers having bipolar flat electrodes forming partitions within the electrolyzer.

Thus, for instance, there is known an electrolyzer for the production of chlorine and hydrogen from hydrochloric acid, comprising bipolar graphite plate electrodes which serve as partitions dividing the cell into several sections, and diaphragms mounted between said electrodes. The space between the diaphragms and the anode sides of the bipolar electrodes is filled with graphite crumb for the purpose of increasing the actual surface of an electrode. However, such embodiments of electrolyzers, most of which are of filter press type, are cumbersome, difficult to maintain and are not compact enough.

It is an object of the present invention to obviate the above disadvantages.

Another object of the invention is to provide a compact high-efficiency electrolyzer comprising series connected cells, using the advantages of feeding high intensity current to the developed surface of electrodes composed of pieces and of the high voltage generated during the bipolar action of said pieces.

These objects are accomplished by providing an electrolyzer comprising: a cell, the inner surface of which is made from a dielectric material, said cell being filled with a circulating electrolyte; current leads which are non-soluble and arranged in said cell; a bulk electrode composed of pieces of a conducting material, said pieces filling the space between the current leads and the walls of the cell, said pieces of a current conducting material receiving, upon having reacted with the circulating electrolyte, a coat of film preventing current leakage through the metallic contact between said pieces which operate as bipolar elements when the current leads are energized; and a means for discharging slime and products of electrolysis, connected with said cell.

It is advisable to make the cell narrowing at the top to increase the speed of the electrolyte's circulation.

To ensure optimum efficiency of operation of the power source it is advisable to make one of the current leads flexible and to adjust the voltage across the electrolyzer by changing the height of the working layer.

According to the invention, the current leads of the electrolyzer should preferably be made as grids, the mesh of the upper current lead being big enough for charging pieces of the material composing the bulk electrode, the mesh of the lower current lead being sufficient for discharging the electrolyte.

To increase the speed of the electrolyte's circulation and to maintain the bipolarly operating pieces in a suspended state, it is advisable to provide the lower portion of the bath with an inlet connection for feeding as, for instance, oxygen or air, therethrough into the electrolyte.

The method of conducting electrolysis in an electrolyzer comprising an insulated cell having non-soluble current leads consists in that the space between the current leads is charged in layers with pieces of a current conducting material, said pieces, when reacting with the circulating electrolyte, receiving a coat of a high resistance film promoting the bipolar action of said pieces and preventing current leakage through the metallic contact between said pieces; the current leads mounted in the electrolyzer are then energized, creating thereby an electric field ensuring a potential difference across the oppositely charged portions of adjacent pieces, said potential difference being sufficient for obtaining the desired product; the electrolyte is made to circulate through the use of the lifting force of the gases evolving during the electrolysis, said gases saturating the electrolyte, reducing thereby its conductivity, thus preventing current leakage through the electrolyte washing said pieces, and ensuring passage of the current primarily through the pieces and through the electrolyte therebetween.

It is advisable to use manganese alloys as the conducting material for the bulk electrode pieces soluble in an alkali solution, thereby providing for the production of permanganates.

A fuller understanding of the invention will be had from the following description of a specific embodiment thereof, taken in conjunction with the accompanying drawings, wherein.

Figure 1:
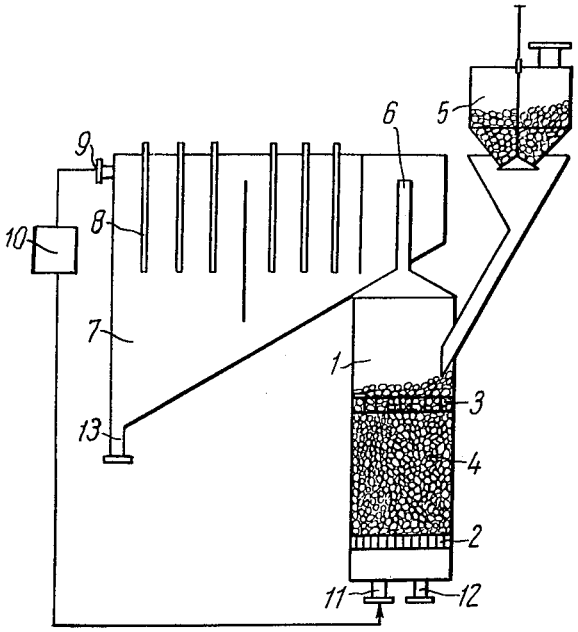
FIG. 1 shows an electrolyzer according to the invention.

The electrolyzer for obtaining chemical products, according to the invention, comprises a hermetically sealed cell 1 (FIG. 1), the inner surface of which is made from a dielectric material, such as vinyl or fluorine plastic. The cell 1 is essentially a hollow cylinder with non-soluble current leads 2 and 3 arranged at right angles to the walls of the cell and made as grids, through which the electrolyte is made to circulate. The space between the non-soluble current leads 2 and 3 is filled with pieces 4 of a conducting material. In order to provide for tightness and to prevent gas leakage, the pieces 4 of conducting material are charged from a bin 5 through the lead 3, the mesh of the grid being big enough for free passage of the pieces of conducting material forming the bulk electrode. The bath 1 is narrowing at the top portion thereof, forming an air-lift pipe 6 through which the electrolyte flows into a settler 7 having heat exchangers 8 which maintain an optimum temperature of the circulating electrolyte. The settler 7 is provided with a drain pipe 9 coupled through a pipe connection 11, mounted in the bottom of the electrolyzer, with an electrolyte interrupter 10. Besides, the bottom of the electrolyzer is provided with a pipe connection 12 for feeding air or oxygen whenever necessary. The finished product is discharged through a pipe connection 13 arranged in the lower portion of the settler 7.

Figure 2:
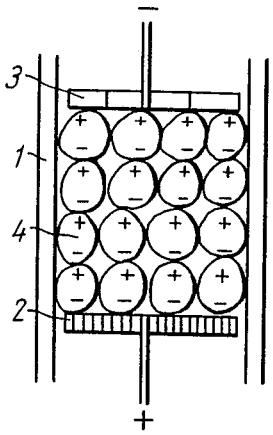
FIG. 2 is a diagram illustrating the bipolar action of the bulk electrodes.

The electrolyzer operates as follows: the pieces 4 of conducting material are charged from the bin 5, fill the space between the lower and upper current leads 2 and 3, and serve as a bulk electrode. The cell 1 of the electrolyzer and the settler 7 are filled with electrolyte up to the level of the drain pipe 9. As the pieces 4 of conducting material react with the electrolyte, their surface receives a coat of film of reduced conductivity. The leads 2 and 3 are energized from an external power source, whereby an electric field is created within the electrolyzer. Thereby, a potential difference develops across the opposite sides of each piece 4, sufficient for the formation of desired products. The above results in the formation of a plurality of electrochemical cells arranged in series one above another, composed of the oppositely charged opposite sides of adjacent pieces 4 of conducting material, said pieces being washed by the electrolyte as shown in FIG. 2.

The direct transfer of current through the metallic contact between the pieces 4 is impeded because of the high contact resistance resulting from the point contact between the pieces 4 of conducting material and the film developing on the surface of the pieces 4 as said pieces contact the electrolyte, said coat of film being of reduced conductivity. Current leakage through the electrolyte bypassing the pieces 4 is prevented because such conditions are created as to provide for a high resistance of the electrolyte and low polarizability of the electrode. Under these conditions, most of the current passes through a plurality of pieces arranged one above another, producing thereby an electrochemical action, i.e., redox reactions, on the opposite sides of adjacent pieces 4. These reactions are accompanied by liberation of the gaseous products of reaction, the lifting force whereof provides for circulation of the electrolyte and for the discharging of the obtained products as well as slime from the reaction space into the settler 7 wherein said products and slime are separated, while the clarified solution flows back into the lower portion of the cell 1 through the pipe connection 11. The bypass current circuit through the circulating electrolyte is interrupted by the electrolyte interrupter 10. Whenever the lifting force generated by the gases evolving during the electrolysis is not sufficient, or whenever the process can be intensified by feeding in a gaseous product, the latter is supplied additionally through the pipe connection 12 mounted in the bottom of the bath 1.

For processes which require low current density, only a portion of the space between the current leads 2 and 3 is filled with the pieces 4 of conducting material (bulk electrode). The size of the pieces must not exceed 500 microns. The circulating electrolyte and the gases, supplied through the pipe connection 12 whenever necessary, maintain said pieces in a fluidized state, ensuring a developed surface of the bipolar bulk electrode. The developed surface of the bulk electrode permits substantially increasing the electrolyzer efficiency by increasing the current intensity.

Figure 3:
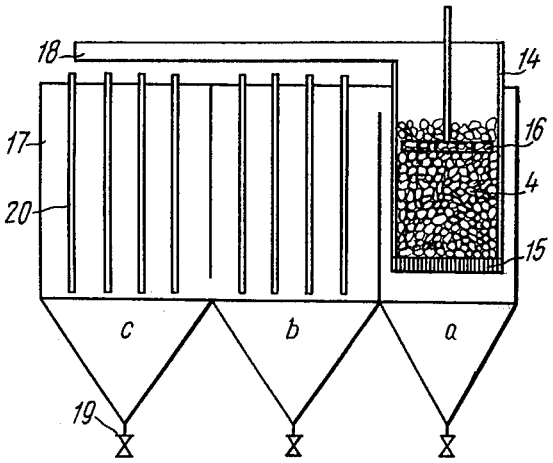
FIG. 3 shows another embodiment of the electrolyzer.

The embodiment shown in FIG. 3 is intended for processes involving liberation of great amounts of gases to ensure sufficient speed of circulation of the electrolyte. This embodiment comprises a cell 14 which is made from a dielectric material and is an open hollow container, the bottom of which is a grid serving as one of the current leads 15 and supporting pieces 4 of conducting material placed thereon, said pieces serving as a bulk electrode. The top portion of the cell 14 is provided with a movable current lead 16 arranged at a right angle to the walls of the cell 14, the pieces 4 being charged through the grid of the current lead 16. The cell 14 is arranged inside a settler 17 filled with an electrolyte, which seeps through the lower grid-like current lead 15 into the cell 14. The top portion of the cell 14 terminates above the settler 17 and is connected with a trough 18 arranged above the settler 17. The settler 17 comprises several compartments "a", "b", "c", which are partially separated by partitions. The cell 14 of the electrolyzer is mounted in one of the extreme compartments "a", whereas the trough 18 terminates above the other extreme compartment "c", ensuring flow of the electrolyte therefrom into the compartment "c" of the settler 17. The bottom of each of the compartments "a", "b", "c" is conical and is provided with a discharge pipe connection 19, through which the finished product and the spent electrolyte are discharged. In the compartments "b" and "c", there are arranged heat exchangers 20 maintaining an optimum temperature of the electrolyte. The operating principle of the proposed electrolyzer is similar to that of the above-described electrolyzer of FIG. 1. The electrolyte with the reaction products, circulating under the action of the lifting force of the gases evolving during the electrolysis, flows upwards within the cell 14, over into the trough 18, wherefrom it is then discharged into the compartment "c" and passes along the walls of the heat exchangers 20 maintaining the required temperature of the electrolyte. The solid products of the reaction are settled in the conical portion of each of the compartments "a", "b", "c", while the clarified electrolyte is again supplied into the cell 14.

The proposed electrolyzer is suitable for processes with both soluble and non-soluble pieces.

A METHOD OF ELECTROCHEMICAL PRODUCTION OF POTASSIUM PERMANGANATE

According to the proposed method, electrolysis is conducted within a layer of pieces of manganese and alloys thereof between the current leads at a current density across the layer of 50 to 150 $A/dm^2$ and a temperature of 30° to 50° C. and providing for circulation of the electrolyte which is an alkali solution. Each individual piece within the layer works bipolarly, serving as an anode for each preceding piece and as a cathode for each subsequent piece. Dissolution of the anode side of each piece results in the formation of potassium permanganate in the alkali solution.

Example: electrolyte composition: KOH—200 g/l, $K_2CO_3$—50 g/l. Composition of ferromanganese: 80% Mn, 10% Fe, 6% C. Size of pieces—5 to 150 mm, height of the layer—600 mm.

Electrolysis is conducted at a current density of 6500 A, at a voltage of 90 V, and at an electrolyte temperature of 30° to 50° C. The circulation of the electrolyte is attained by means of the gases evolving during the electrolysis.

The use of the proposed method makes it possible to avoid labor-consuming and costly operations of melting anodes, as well as trimming and securing them on bars; to preclude loss of power across the contacts and bars connecting a plurality of series-connected electrolyzers replaced by a single unit, reducing substantially the floor area requirements, power consumption and capital investment.

The proposed electrolyzer may also be used for other processes similar to the one described above, for instance, for the production of manganate, high-valent compounds of chlorine, production of a mixture of alloys of various metals and oxychloric compounds.

What is claimed is:

1. An electrolyzer for obtaining chemical products, consisting essentially of: a cell, the inner surface of said cell being made from a dielectric material; current leads which are non-soluble and arranged within said cell; a bulk electrode consisting of a bed of pieces of conducting material, said pieces filling the space between said current leads and the walls of the cell; a coat of film on said pieces, said film obtained by chemical reaction with said pieces of conducting material and having reduced conductivity as compared to said conducting material and promoting the bipolar action of said pieces when said current leads are energized; and a means for discharging slime and products of electrolysis communicating with said cell.

2. An electrolyzer as claimed in claim 1, wherein said cell is a container narrowing in the top portion thereof, thereby providing for a higher speed of circulation of the electrolyte owing to the lifting force of the gases evolving during the electrolysis.

3. An electrolyzer as claimed in claim 1, wherein one of the current leads is movable.

4. An electrolyzer as claimed in claim 1, wherein said current leads are made as grids, the mesh of the top current lead permitting the pieces of the bulk electrode to be charged therethrough, while the mesh of the lower lead is sufficient for the passage therethrough of the electrolyte enriched with the reaction products.

5. An electrolyzer as claimed in claim 1, wherein, for the purpose of increasing the speed of the electrolyte circulation, the bottom portion of the cell is provided with a pipe connection for supplying a gas selected from the group consisting of oxygen and air therethrough into the electrolyte.

6. The electrolyzer according to claim 1 wherein the conducting material is selected from the group consisting of manganese and alloys thereof and the film is the reaction product of said conducting material with an alkali solution containing potassium ions.

7. The electrolyzer according to claim 1 comprising a source of direct current connected to said current leads.

* * * * *